US012753578B2

(12) United States Patent
Yuet et al.

(10) Patent No.: US 12,753,578 B2
(45) Date of Patent: Oct. 6, 2026

(54) SYSTEM AND METHOD FOR DELIVERING BEAMS TO PREDETERMINED LOCATIONS OF WORKSITE

(71) Applicant: Caterpillar Inc., Peoria, IL (US)

(72) Inventors: Fu P. Yuet, Clayton, NC (US); Barrett A Flinn, Mount Holly, NC (US); Tyler Parziale, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 164 days.

(21) Appl. No.: 18/536,960

(22) Filed: Dec. 12, 2023

(65) Prior Publication Data

US 2025/0188708 A1 Jun. 12, 2025

(51) Int. Cl.
*E02F 9/20* (2006.01)

(52) U.S. Cl.
CPC ..... *E02F 9/2054* (2013.01); *E02F 9/205* (2013.01)

(58) Field of Classification Search
CPC ..... E02F 9/2054; E02F 9/205
See application file for complete search history.

(56) References Cited

U.S. PATENT DOCUMENTS

2014/0019042 A1* 1/2014 Sugawara ..... G01S 19/45 701/431
2014/0292544 A1* 10/2014 Borland ..... G08G 1/207 340/988
2015/0233076 A1* 8/2015 Montgomery ..... E02D 7/00 405/184.5
2016/0024757 A1* 1/2016 Nomura ..... E02F 9/2054 701/32.3
2018/0173221 A1* 6/2018 Samaraweera ..... G05D 1/0217
2018/0284784 A1* 10/2018 Kobashi ..... G05D 1/0274
2021/0285168 A1* 9/2021 Gundala ..... E01C 19/4873
2024/0210946 A1* 6/2024 Ready-Campbell ... G05D 1/246

FOREIGN PATENT DOCUMENTS

CN 113981969 A 1/2022
WO 2012010133 A2 1/2012
WO WO-2023060318 A1 * 4/2023 ..... E02D 7/22

OTHER PUBLICATIONS

Groundwork, Challenger 1500 Pile Placer, www.groundworkexperts.com (4 pgs.) xxx.

* cited by examiner

*Primary Examiner* — Hunter B Lonsberry
*Assistant Examiner* — Harrison Heflin

(57) ABSTRACT

A method for delivering beams to predetermined locations of a worksite includes determining, by a control system, a first location associated with a delivery machine at the worksite and issuing, by the control system, a first instruction to a supply machine to transport the beams to the first location. The method further includes instructing, by the control system, an implement system of the supply machine to unload the beams into a receptacle of the delivery machine at the first location and issuing, by the control system, a first command to the delivery machine to travel sequentially to each predetermined location. Further, the method includes instructing, by the control system, an articulatable work tool system of the delivery machine to grasp the beams received within the receptacle and release one or more beams at the predetermined locations in preset orientations.

20 Claims, 12 Drawing Sheets

SYSTEM AND METHOD FOR DELIVERING BEAMS TO PREDETERMINED LOCATIONS OF WORKSITE

TECHNICAL FIELD

The present disclosure relates to delivering beams to predetermined locations of a worksite. More particularly, the present disclosure relates to a system and method for delivering the beams to the predetermined locations of the worksite, at least in part, by using autonomous or semi-autonomous machines.

BACKGROUND

In recent decades, there has been a general move towards the use of renewable resources, such as solar power, to generate energy. As a result, numerous solar farms are being installed all over the world every year. The installation of solar farms requires large quantities of solar panels, torsion bars, and beams to be delivered to designated locations of a solar farm. While solar panels may be delivered in crates, components, such as, beams may be delivered in loose batches to the designated locations of the solar farm in supply machines. Once a supply machine reaches a designated location, workers are typically required to manually unload the beams and place them at the designated locations in a desired orientation. Such conventional methods for delivering such components at desired locations, e.g., in a solar farm are time-consuming and labor-intensive.

United States Patent Application No.: 20150233076 relates to a method of inserting an elongate element into a ground surface, including drilling at a first drilling location in the ground surface. The drilling is performed by a boring tool of a first vehicle. The elongate element is transported to the first drilling location. The transporting is performed by a second vehicle. The elongate element is handed off from the second vehicle to the first vehicle. The elongate element is inserted into the first drilling location. The inserting is performed by an inserting device of the first vehicle.

SUMMARY OF THE INVENTION

In one aspect, the disclosure relates to a method for delivering one or more beams to one or more predetermined locations of a worksite. The method includes determining, by a control system, a first location associated with a delivery machine at the worksite. The delivery machine includes a receptacle to receive the one or more beams and an articulatable work tool system to operatively engage with each beam of the one or more beams received within the receptacle. The method further includes issuing, by the control system, a first instruction to a supply machine to transport the one or more beams to the first location. The supply machine includes an implement system to carry the one or more beams. The method further includes instructing, by the control system, the implement system to unload the one or more beams into the receptacle of the delivery machine at the first location and issuing, by the control system, a first command to the delivery machine to travel sequentially to each predetermined location of the one or more predetermined locations. Further, the method includes instructing, by the control system, the articulatable work tool system to grasp the one or more beams received within the receptacle and release the one or more beams correspondingly at the one or more predetermined locations to deploy the one or more beams at the one or more predetermined locations in preset orientations.

In another aspect, the disclosure is directed to a system for delivering one or more beams to one or more predetermined locations of a worksite. The system includes a delivery machine including a receptacle to receive the one or more beams and an articulatable work tool system to operatively engage with each beam of the one or more beams when received in the receptacle. The system further includes a supply machine including an implement system to carry the one or more beams to a first location associated with the delivery machine at the worksite and supply the one or more beams to the delivery machine at the first location of the worksite. Further, the system includes a control system communicatively coupled to the delivery machine and the supply machine. The control unit is configured to determine the first location associated with the delivery machine at the worksite, issue a first instruction to the supply machine to transport the one or more beams to the first location, and instruct the implement system to unload the one or more beams into the receptacle of the delivery machine at the first location. The control unit is further configured to issue a first command to the delivery machine to travel sequentially to each predetermined location of the one or more predetermined locations and instruct the articulatable work tool system to grasp the one or more beams received within the receptacle and release the one or more beams correspondingly at the one or more predetermined locations to deploy the one or more beams at the one or more predetermined locations in preset orientations.

DETAILED DESCRIPTION

Reference will now be made in detail to specific aspects or features, examples of which are illustrated in the accompanying drawings. Wherever possible, corresponding, or similar reference numbers will be used throughout the drawings to refer to the same or corresponding parts. Generally, corresponding reference numbers may be used throughout the drawings to refer to the same or corresponding parts, e.g., 1, 1', and 1" could refer to one or more comparable components used in the same and/or different depicted embodiments.

Figure 1:
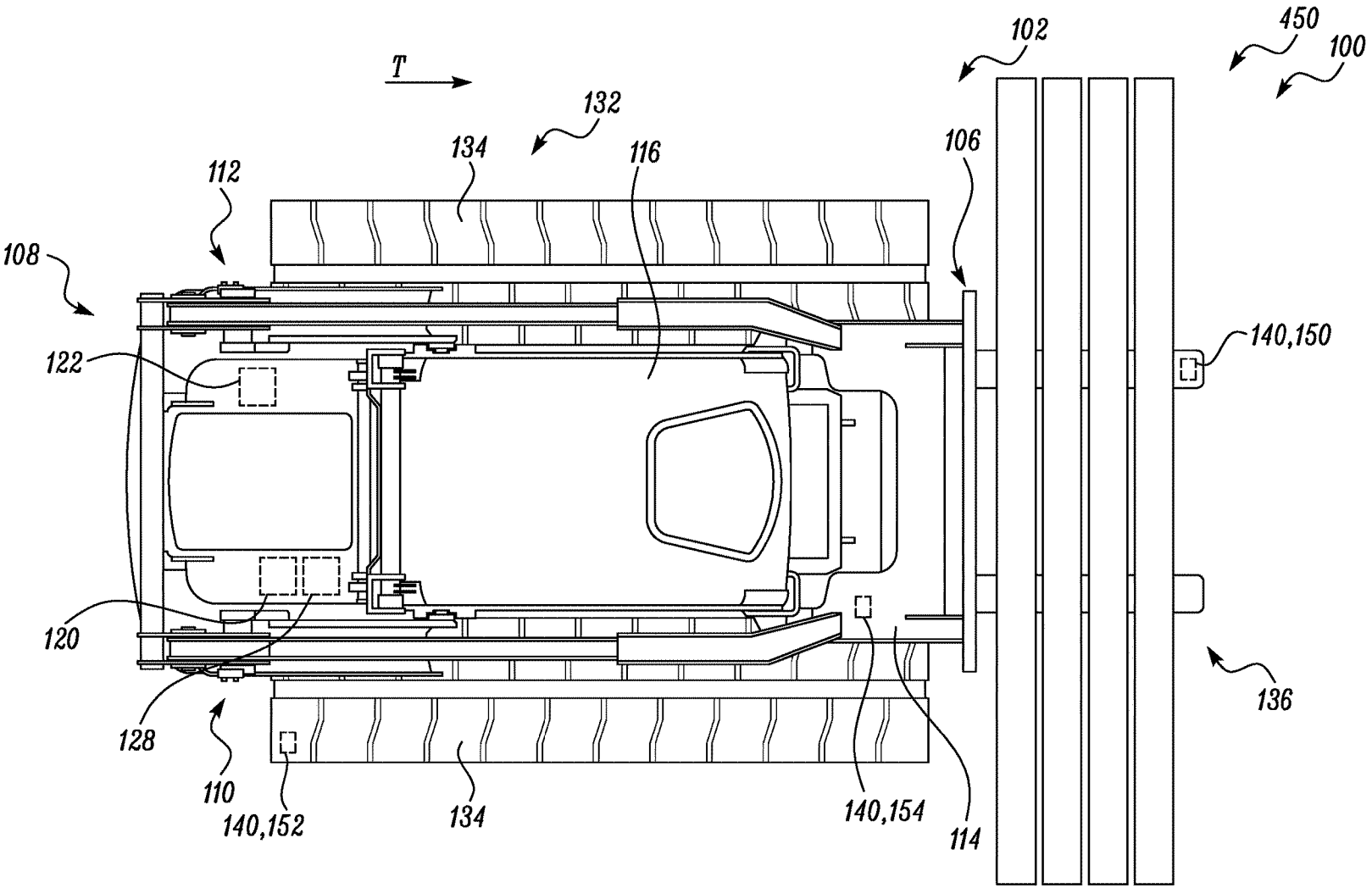
FIG. 1 illustrates an exemplary supply machine, in accordance with one or more aspects of the present disclosure.

Referring to FIG. 1, an exemplary supply machine 100 is shown and described. The supply machine 100 may include a compact track loader 102, although other machine types are possible. The supply machine 100 may be employed to supply items on a worksite, for example, a worksite 300 (shown in FIG. 3). For example, supplying the item may mean loading the items, carrying the items up to another machine or up to a location of another machine on the worksite 300, and unloading the items onto the other machine. Although FIG. 1 illustrates the supply machine 100 as the compact track loader 102, it would be appreciated that the supply machine 100 may include other loading machines, such as, a compact wheel loader, a multi-terrain loader, and/or the like.

As shown in FIG. 1, the supply machine 100 may define a supply machine forward end 106 and a supply machine rearward end 108 opposite to the supply machine forward end 106. The supply machine forward end 106 and the supply machine rearward end 108 may be defined in relation to an exemplary direction of travel T of the supply machine 100, with said direction of travel T being defined exemplarily from the supply machine rearward end 108 towards the supply machine forward end 106. Further, terms such as 'left' and 'right', as used in the present disclosure, may be understood as the supply machine 100 is viewed from the supply machine rearward end 108 towards the supply machine forward end 106. The supply machine 100 may include a supply machine first side 110 and a supply machine second side 112 opposite to the supply machine first side 110. The supply machine first side 110 may correspond to the right side of the supply machine 100 and the supply machine second side 112 may correspond to the left side of the supply machine 100 when viewing the supply machine 100 from the supply machine rearward end 108 towards the supply machine forward end 106.

The supply machine 100 may include a supply machine frame 114 and a supply machine operator station 116 supported on the supply machine frame 114. The supply machine operator station 116 may house any number of output devices and control devices (e.g., a throttle control, a braking control, a steering device, etc.) that an operator may use to facilitate an operator in operating the supply machine 100. The output device may include buttons, screens, lights, switches, and any other output device that can provide one or more of auditory, visual, or haptic feedback to the operator.

In some embodiments, the supply machine 100 may be operated autonomously (without an operator on board) or semi-autonomously (with some operations performed without input from an operator). As an example, the operator may be stationed within the supply machine 100 or remote to the supply machine 100. To this end, the supply machine 100 may include a supply machine controller 120 that controls various operations of the supply machine 100. The supply machine controller 120 may be supported on the supply machine frame 114 of the supply machine 100.

In some embodiments, the supply machine 100 may include a supply machine transceiver 122 to receive instructions from a remote controller 402 (shown in FIG. 4) to operate autonomously or semi-autonomously. The supply machine transceiver 122 may be communicatively coupled to the remote controller 402 (shown in FIG. 4) through a communication link. The communication link may be a satellite link, a cellular link, or other link known in the art. The supply machine transceiver 122 may be communicatively coupled to the supply machine controller 120 to provide the instructions from the remote controller 402 (shown in FIG. 4) to the supply machine controller 120 to control the operations of the supply machine 100. The supply machine transceiver 122 may be supported anywhere on the supply machine 100. In some embodiments, the supply machine 100 may also include a memory (not shown) to store data, for example, data received from the remote controller 402 (shown in FIG. 4), associated with the operations of the supply machine 100. The memory (not shown) may be accessed by the supply machine controller 120 to obtain and store data associated with the operations of the supply machine 100.

The supply machine 100 may further include a supply machine power source 128. The supply machine power source 128 may be supported on the supply machine frame 114 and may be configured to provide mechanical and/or electrical power to the supply machine 100. The supply machine power source 128 may include one or more of an internal combustion engine, an electric generator, a fluid pump, a fuel cell, a battery, or any other suitable device configured to power the supply machine 100. In one example, the supply machine power source 128 may be configured to propel the supply machine 100 on the worksite and provide power to various components associated with the supply machine 100, upon receiving instructions from the supply machine controller 120.

The supply machine 100 may include a supply machine traction system 132 including one or more supply machine traction devices 134 to provide tractive force to the supply machine 100. Exemplarily, the supply machine 100 may include two supply machine traction devices 134 disposed on the supply machine first side 110 and the supply machine second side 112, respectively, of the supply machine 100. Although FIG. 1 shows only two supply machine traction devices 134 in the supply machine traction system 132, it will be appreciated that lesser or greater number of the supply machine traction devices 134 may be contemplated. The supply machine traction devices 134 may include tracks, wheels, or a combination thereof. The supply machine traction devices 134 may be rotatably supported on the supply machine frame 114 and operatively connected to one or more motors (not shown) to drive the supply machine traction devices 134 to propel the supply machine 100 on the worksite. The motors (not shown) may be configured to modify a speed of the supply machine 100 by modifying a speed of rotation of the one or more supply machine traction devices 134 upon receiving instructions from the supply machine controller 120. The motors (not shown) may be powered by the supply machine power source 128 and operably coupled to the supply machine power source 128 via electrical wires, fluid conduits, or any other suitable connection.

The supply machine 100 may include a supply machine implement system 136 to carry the item up to the other machine and load the item onto the other machine on the worksite. The supply machine implement system 136 may include forks, buckets, and the like. The supply machine implement system 136 may be pivotally mounted to the supply machine forward end 106 of the supply machine frame 114. The supply machine implement system 136 may be tilted up or down to load and/or unload the item based on the instructions from the supply machine controller 120. In some embodiments, the supply machine implement system 136 may be hydraulically powered to be tilted up or down using a hydraulic cylinder (not shown) to load and/or unload the item.

In some embodiments, a plurality of on-board supply machine sensors 140 may be disposed on one or more parts of the supply machine 100 to sense one or more parameters of the parts of the supply machine 100. For example, the on-board supply machine sensors 140 may include one or more supply machine location sensors 150 to sense the location and/or position of the supply machine 100 and/or the supply machine implement system 136, and generate location data corresponding to the sensed location. For example, the supply machine location sensors 150 may include one or more of a Global Positioning System (GPS), a Global Navigation Satellite System (GNSS), or any other location tracking system known in the art.

The on-board supply machine sensors 140 further include one or more supply machine speed sensors 152 to sense the rotational speed of the supply machine traction devices 134 and generate machine speed data. In some examples, the supply machine speed sensors 152 may include a magnetic pickup, an inertial measurement unit (IMU), an optical sensor, or any other speed sensors known in the art. The on-board supply machine sensors 140 further include one or more supply machine acceleration sensors 154 to sense the orientation of the supply machine 100 and/or the supply machine implement system 136 and generate orientation data corresponding to the sensed orientation. The on-board supply machine sensors 140 are well known in the art and hence, not described in greater detail for the sake of brevity of the disclosure.

Figure 2:
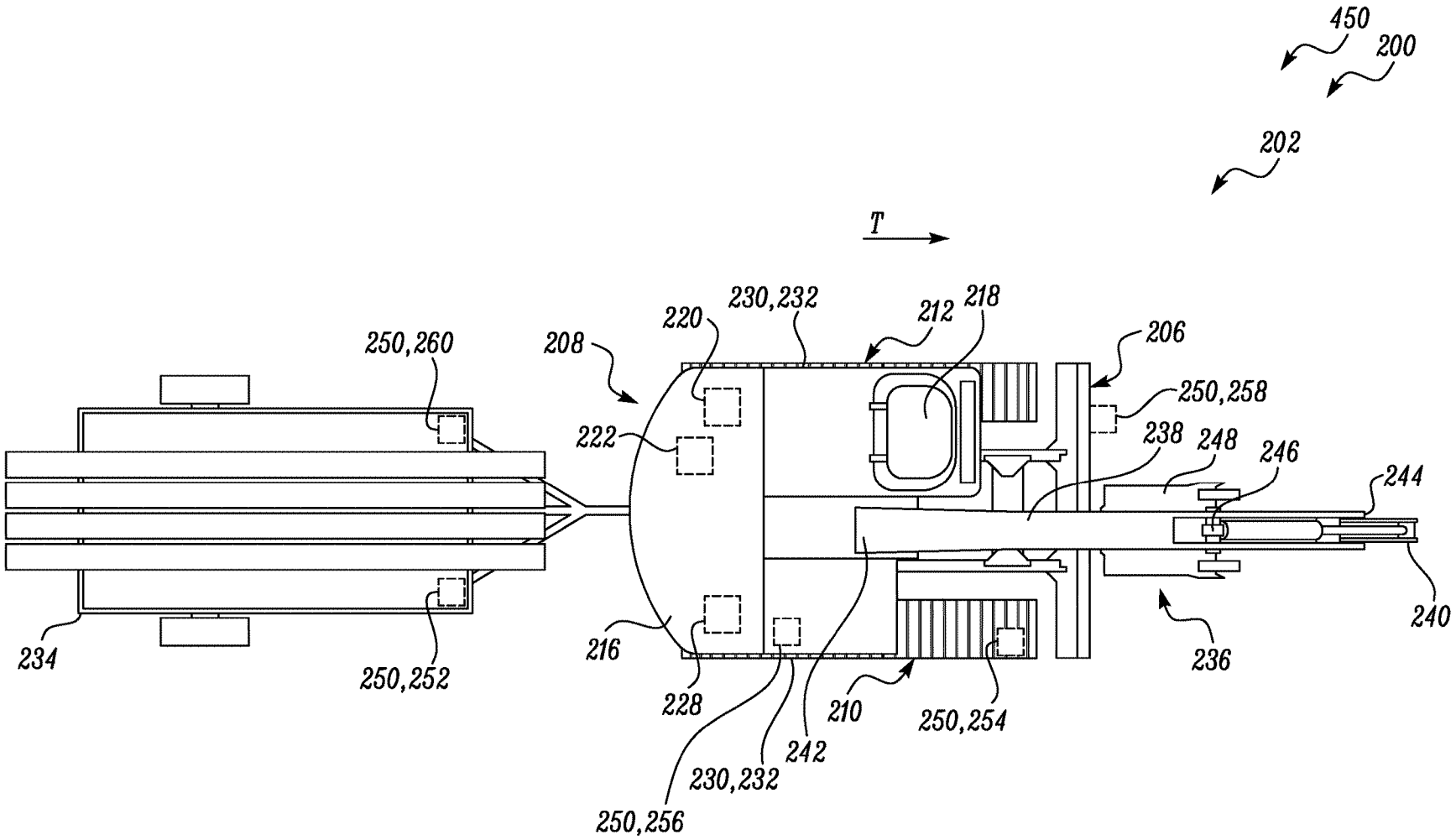
FIG. 2 illustrates an exemplary delivery machine, in accordance with one or more aspects of the present disclosure.

Referring to FIG. 2, an exemplary delivery machine 200 is shown and described. The delivery machine 200 may include a mini excavator 202, although other machine types are possible. The delivery machine 200 may be employed to receive the items from the supply machine 100 (shown in FIG. 1) and release the items at one or more predetermined locations on the worksite, for example, the worksite 300 (shown in FIG. 3). For example, releasing the items may include grasping the items and releasing the items at the predetermined locations to deploy the items at the predetermined locations on the worksite in preset orientations. Although FIG. 2 illustrates the delivery machine 200 as the mini excavator 202, it would be appreciated that the delivery machine 200 may include any other type of excavators capable of grasping the item and releasing it at the predetermined locations on the worksite.

As shown in FIG. 2, the delivery machine 200 may define a delivery machine forward end 206 and a delivery machine rearward end 208 opposite to the delivery machine forward end 206. The delivery machine forward end 206 and the delivery machine rearward end 208 may be defined in relation to an exemplary direction of travel T of the delivery machine 200, with said direction of travel T being defined exemplarily from the delivery machine rearward end 208 towards the delivery machine forward end 206. Further, terms such as 'left' and 'right', as used in the present disclosure, may be understood as the delivery machine 200 is viewed from the delivery machine rearward end 208 towards the delivery machine forward end 206. The delivery machine 200 may include a delivery machine first side 210 and a delivery machine second side 212 opposite to the delivery machine first side 210 of the delivery machine 200. The delivery machine first side 210 may correspond to the right side of the delivery machine 200 and the delivery machine second side 212 may correspond to the left side of the delivery machine 200 when viewing the delivery machine 200 from the delivery machine rearward end 208 towards the delivery machine forward end 206.

The delivery machine 200 may include a delivery machine frame 216 and a delivery machine operator station 218 supported on the delivery machine frame 216. The delivery machine operator station 218 may house any number of output devices and control devices (e.g., a throttle control, a braking control, a steering device, etc.) that an operator may use to facilitate operating the delivery machine 200. The output device may include buttons, screens, lights, switches, and any other output device that can provide one or more of auditory, visual, or haptic feedback to the operator.

In some embodiments, the delivery machine 200 may be operated autonomously (without an operator on board) or semi-autonomously (with some operations performed without input from an operator). As an example, the operator may be stationed within the delivery machine 200 or remote to the delivery machine 200. To this end, the delivery machine 200 may include a delivery machine controller 220 that controls various functions of the delivery machine 200. The delivery machine controller 220 may be supported on the delivery machine frame 216 of the delivery machine 200.

In some embodiments, the delivery machine 200 may include a delivery machine transceiver 222 to receive instructions from the remote controller 402 (shown in FIG. 4) to operate autonomously or semi-autonomously. The delivery machine transceiver 222 may be communicatively coupled to the remote controller 402 (shown in FIG. 4) through a communication link. The communication link may be a satellite link, a cellular link, or other link known in the art. The delivery machine transceiver 222 may be communicatively coupled to the delivery machine controller 220 to provide the instructions from the remote controller 402 (shown in FIG. 4) to the delivery machine controller 220 to control the operations of the delivery machine 200. The delivery machine transceiver 222 may be supported anywhere on the delivery machine 200. In some embodiments, the delivery machine 200 may also include a memory (not shown) to store data, for example, data received from the remote controller 402 (shown in FIG. 4), associated with the operations of the delivery machine 200. The memory (not shown) may be accessed by the delivery machine controller 220 to obtain and store data associated with the operations of the delivery machine 200.

The delivery machine 200 may further include a delivery machine power source 228. The delivery machine power source 228 may by supported on the delivery machine frame 216 and may be configured to provide mechanical and/or electrical power to the delivery machine 200. The delivery machine power source 228 may include one or more of an internal combustion engine, an electric generator, a fluid pump, a fuel cell, a battery, or any other suitable device configured to power the delivery machine 200. In one example, the delivery machine power source 228 may be configured to propel the delivery machine 200 on the worksite and provide power to various components associated with the delivery machine 200 upon receiving instructions from the delivery machine controller 220.

The delivery machine 200 may include a delivery machine traction system 230 including one or more delivery machine traction devices 232 to provide tractive force to the delivery machine 200. Exemplarily, the delivery machine 200 may include two delivery machine traction devices 232 disposed on the delivery machine first side 210 and the delivery machine second side 212, respectively, of the delivery machine 200. Although FIG. 2 shows only two delivery machine traction devices 232, it will be appreciated that lesser or greater number of the delivery machine traction devices 232 may be contemplated. The delivery machine traction devices 232 may include tracks, wheels, or a combination thereof. The delivery machine traction devices 232 may be rotatably supported on the delivery machine frame 216 and operatively connected to one or more motors (not shown) to drive the delivery machine traction devices 232 to propel the delivery machine 200 on the worksite. The motors (not shown) may be configured to modify a speed of the delivery machine 200 by modifying a speed of rotation of the one or more delivery machine traction devices 232 upon receiving instructions from the delivery machine controller 220. The motors (not shown) may be powered by the delivery machine power source 228 and operably coupled to the delivery machine power source 228 via electrical wires, fluid conduits, or any other suitable connection.

The delivery machine 200 may also include a receptacle 234 for receiving the item from the supply machine 100 (shown in FIG. 1). In an exemplary embodiment, the receptacle 234 may be attached (e.g., hingeably coupled) to the delivery machine frame 216 towards the delivery machine rearward end 208 of the delivery machine 200, for example, as a trailer. Although FIG. 2 shows the receptacle 234 connected to the delivery machine rearward end 208 of the delivery machine 200, it would be appreciated that the receptacle 234 may be attached to any of the sides of the delivery machine 200, such as, the delivery machine forward end 206, the delivery machine first side 210, or the delivery machine second side 212 of the delivery machine 200.

The delivery machine 200 may include an articulatable work tool system 236 that operatively engages with each item received in the receptacle 234 by grasping each item received within the receptacle 234 and releasing the item correspondingly at one or more predetermined locations on the worksite. In accordance with various embodiments, the articulatable work tool system 236 is configured to receive instructions from the delivery machine controller 220 to grasp and release the items at the one or more predetermined locations to deploy the one or more items at the one or more predetermined locations in preset orientations. The articulatable work tool system 236 is rotatable with respect to the delivery machine frame 216 for attaining different working positions. The articulatable work tool system 236 may further include a first arm 238 pivotally connected to the delivery machine frame 216 on its first end 242 and a second arm 240 articulated at a second end 244 of the first arm 238. A third end 246 of the second arm 240 further includes a clasping member 248 for grasping and releasing the item. In accordance with various embodiments, the clasping member 248 is configured to operatively engage with each item according to a predefined articulation pattern for deployment of the items in the preset orientation. In some embodiments, when the items are magnetic in nature, the third end 246 of the second arm 240 may include an electro-magnet that can be controlled to grasp and release the items.

In some embodiments, a plurality of on-board delivery machine sensors 250 may be disposed on one or more parts of the delivery machine 200 to sense one or more parameters of the parts of the delivery machine 200. For example, the on-board delivery machine sensors 250 may include one or more delivery machine location sensors 252 to sense the location and/or position of the delivery machine 200 and/or the receptacle 234, and generate location data corresponding to the sensed location. The on-board delivery machine sensors 250 further include one or more delivery machine speed sensors 254 to sense the rotational speed of the delivery machine traction devices 232 and generate speed data. The on-board delivery machine sensors 250 further include one or more delivery machine acceleration sensors 256 to sense the orientation of the delivery machine 200 and/or the receptacle 234 and generate orientation data corresponding to the sensed orientation. The on-board delivery machine sensors 250 may further include one or more obstacle sensors 258 disposed on the delivery machine frame 216 to detect, for example, an object (such as, a personnel or an inanimate object) in proximity to the delivery machine 200. The on-board delivery machine sensors 250 may further include one or more receptacle sensors 260 disposed on the receptacle 234 to detect, for example, a number of items in the receptacle 234. For example, the one or more obstacle sensors 258 and the receptacle sensors 260 may include an image capturing device, a Light Detection and Ranging (LIDAR) system, or any other sensor for detecting a number of items as known in the art. The on-board delivery machine sensors 250 are well known in the art and hence, not described in greater detail for the sake of brevity of the disclosure.

In accordance with various embodiments, the delivery machine 200 is configured to travel sequentially up to each predetermined location of the worksite, for example, as per a predefined travel path. To this end, the delivery machine controller 220 obtains the one or more parameters, such as, the location data, the orientation data, and the speed data of the delivery machine 200 from the on-board delivery machine sensors 250, and controls the delivery machine power source 228 and the delivery machine traction devices 232 to travel to each predetermined location of the worksite based on the predefined travel path. In accordance with various embodiments, the predefined travel path may be defined by a user and may depend upon a terrain and layout of the worksite as well as on the requirement of the user. In some embodiments, data related to the predefined travel path of the delivery machine 200 may be stored in the memory of the delivery machine 200.

Figure 3:
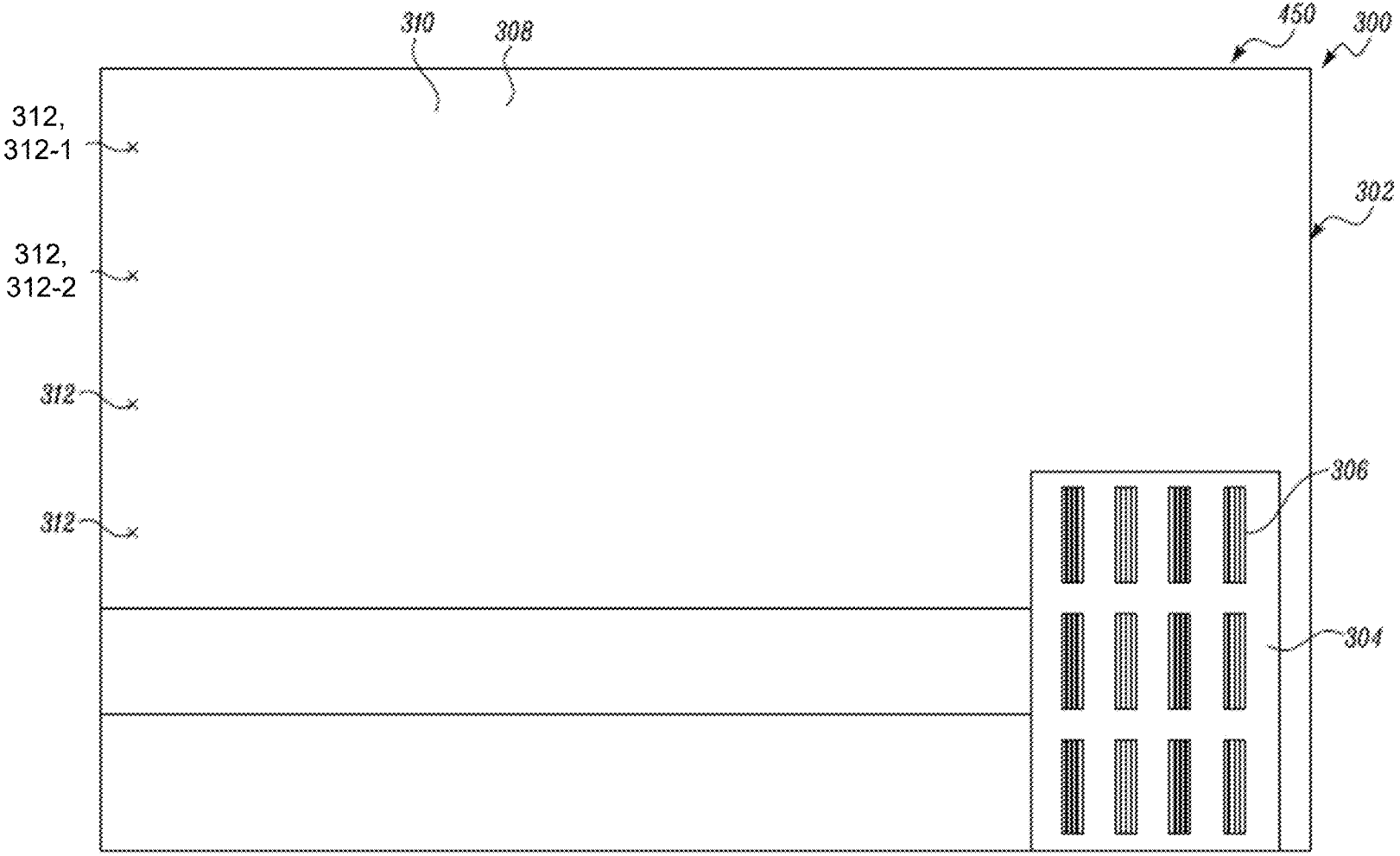
FIG. 3 illustrates an exemplary worksite identifying predetermined locations for delivery of beams, in accordance with one or more aspects of the present disclosure.

FIG. 3 illustrates an exemplary view of the worksite 300 identifying predetermined locations for delivery of items on the worksite 300, in accordance with various embodiments. As shown in FIG. 3, the worksite 300 may be a construction site for the construction of a solar farm 302 that includes a storage facility, such as, a staging area 304 for gathering or accumulating one or more items, for example, beams 306, torsion bars, and panels, required for the construction of the solar farm 302. The worksite 300 may further include a construction area 310 that defines one or more predetermined locations 312 for installing the beams 306 for the construction of the solar farm 302. For construction of any solar farm 302, the beams 306 are required to be moved from the staging area 304 to the one or more predetermined locations 312 of the construction area 310 for deployment of the beams 306 into a ground surface 308 in preset orientation at the one or more predetermined locations 312. The beams 306 may include, but are not limited to, I-beams and/or H-beams.

Once the beams 306 are installed at the worksite 300, the torsion bars and solar panels are delivered from the staging area 304 to the worksite 300 and installed on the beams 306. In accordance with various embodiments, the supply machine 100 (shown in FIG. 1) and the delivery machine 200 (shown in FIG. 2) are utilized to deliver the beams 306 to the predetermined locations 312 of the worksite 300. Although FIG. 3 exemplarily illustrates the worksite 300 as a construction site for constructing a solar farm 302, it would be appreciated that the worksite 300 may include any construction site, such as, a road, a dairy farm, or the like, requiring the distribution of a large number of items, such as the beams 306. Further, it would be appreciated that the item (or items) may include or correspond to any item required to be distributed over the worksite 300 and is not limited to beams 306 shown in or described in relation to FIG. 3.

Figure 4:
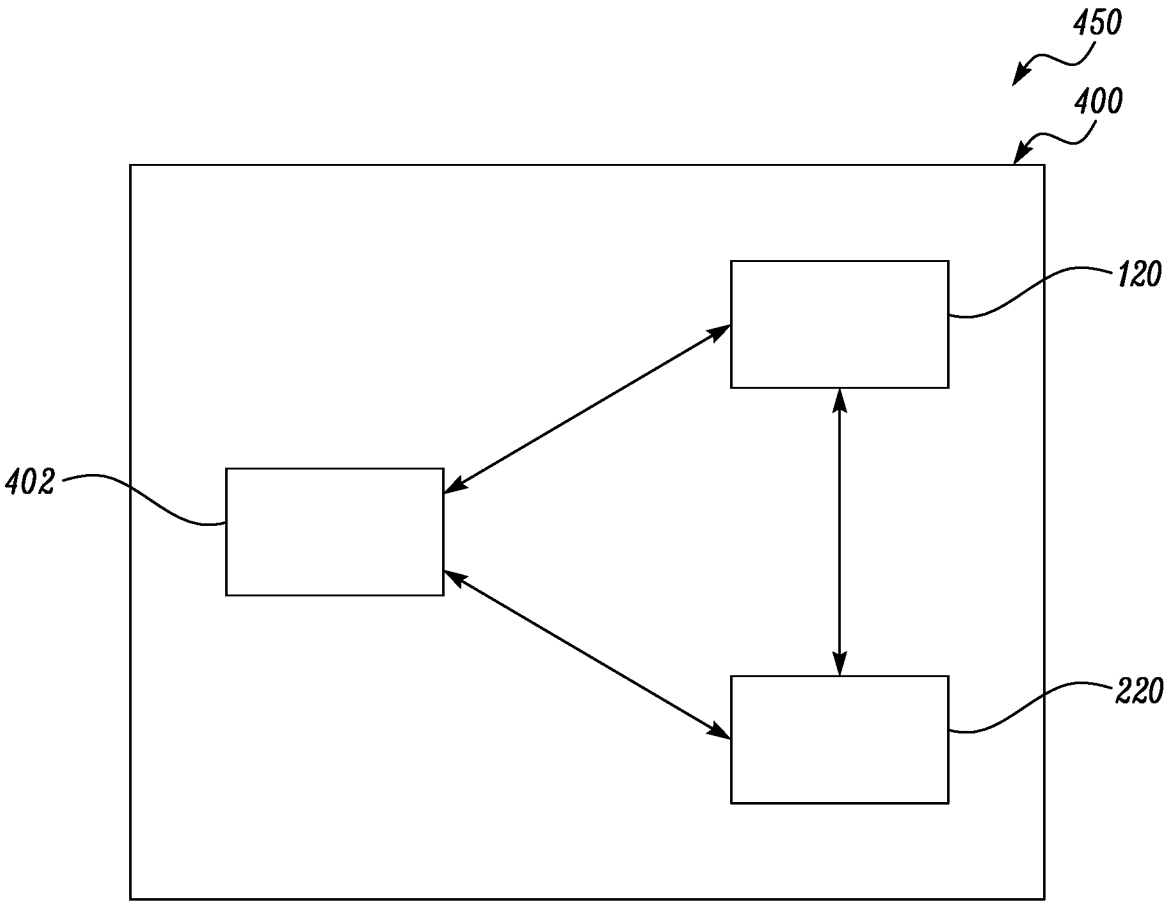
FIG. 4 illustrates a schematic of a control system for controlling the delivery of beams to the predetermined locations of the worksite of FIG. 3, in accordance with one or more aspects of the present disclosure.
Figure 5:
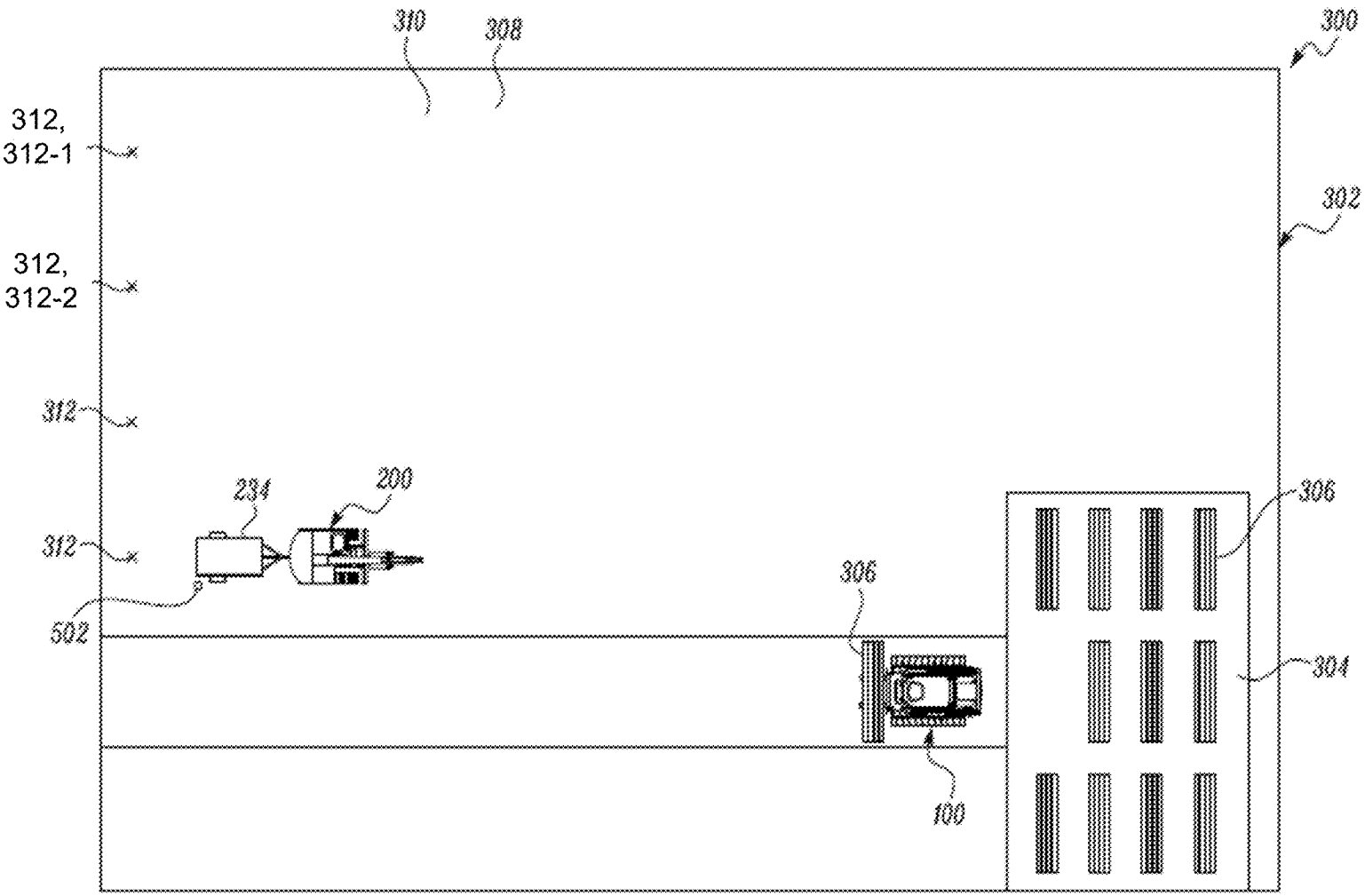
FIGS. 5-11 illustrate exemplary steps performed by the supply machine of FIG. 1 and the delivery machine of FIG. 2 for delivery of the beams to the predetermined locations of the worksite, in accordance with one or more aspects of the present disclosure.
Figure 6:
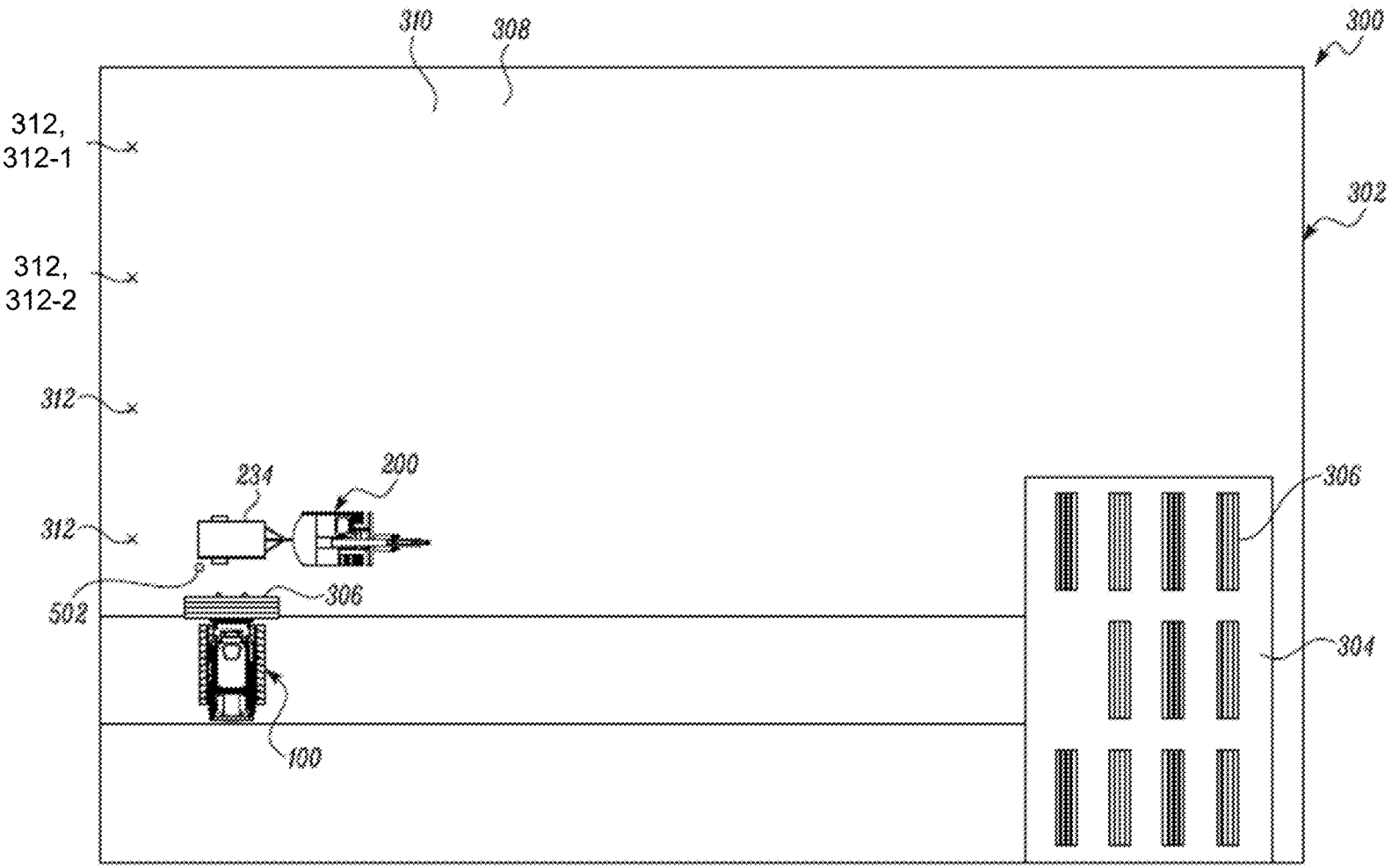

FIG. 4 illustrates a schematic of a control system 400 for controlling the delivery of one or more beams 306 to the one or more predetermined locations 312 of the worksite 300 (shown in FIG. 3), in accordance with various embodiments. The control system 400 includes the remote controller 402, noted above, the supply machine controller 120 (shown in FIG. 1), and the delivery machine controller 220 (shown in FIG. 2) communicatively connected to each other. Each of the remote controller 402, the supply machine controller 120 (shown in FIG. 1), and the delivery machine controller 220 (shown in FIG. 2) communicate with each other through a communication link. The communication link may be a satellite link, a cellular link, or other link known in the art. In accordance with various embodiments, the remote controller 402, the supply machine controller 120 (shown in FIG. 1), and the delivery machine controller 220 (shown in FIG. 2) communicate with each other to control the functioning of the supply machine 100 (shown in FIG. 1) and the delivery machine 200 (shown in FIG. 2) for delivery of the one or more beams 306 to the one or more predetermined locations 312 of the worksite 300 (shown in FIG. 3). In some embodiments, the functions of the remote controller 402 may be performed by the supply machine controller 120 (shown in FIG. 1) and/or the delivery machine controller 220 (shown in FIG. 2). In some embodiments, the control system 400 may be devoid of the remote controller 402 and in such cases, the supply machine controller 120 (shown in FIG. 1) and/or the delivery machine controller 220 (shown in FIG. 2) may communicate directly with each other to control the functioning of the supply machine 100 and the delivery machine 200. Also, in such cases, functions performed by the remote controller 402 may be performed independently or concertedly by one or more of the supply machine controller 120 and/or the delivery machine controller 220, as will be contemplated by someone of skill in the art based on the description of the present disclosure.

Each of the remote controller 402, the supply machine controller 120 (shown in FIG. 1), and the delivery machine controller 220 (shown in FIG. 2) may include one or more of a processor, a microprocessor, a microcontroller, an electronic control module (ECM), an electronic control unit (ECU), or any other suitable means for controlling delivery of the one or more beams to the one or more predetermined locations 312 of the worksite 300 (shown in FIG. 3). The remote controller 402, the supply machine controller 120 (shown in FIG. 1), and the delivery machine controller 220 (shown in FIG. 2) may be implemented using one or more controller technologies, such as Application Specific Integrated Circuit (ASIC) technology, Reduced Instruction Set Computing (RISC) technology, Complex Instruction Set Computing (CISC) technology or any other similar technology now known or developed in the future. The detailed functioning of the remote controller 402, the supply machine controller 120, and the delivery machine controller 220 will now be described in detail with reference to FIGS. 5-12.

According to an exemplary aspect, the delivery machine 200, the supply machine 100, and the control system 400, may be part of a system 450 for delivering the beams 306 to the predetermined locations 312 of the worksite 300.

INDUSTRIAL APPLICABILITY

Figure 12:
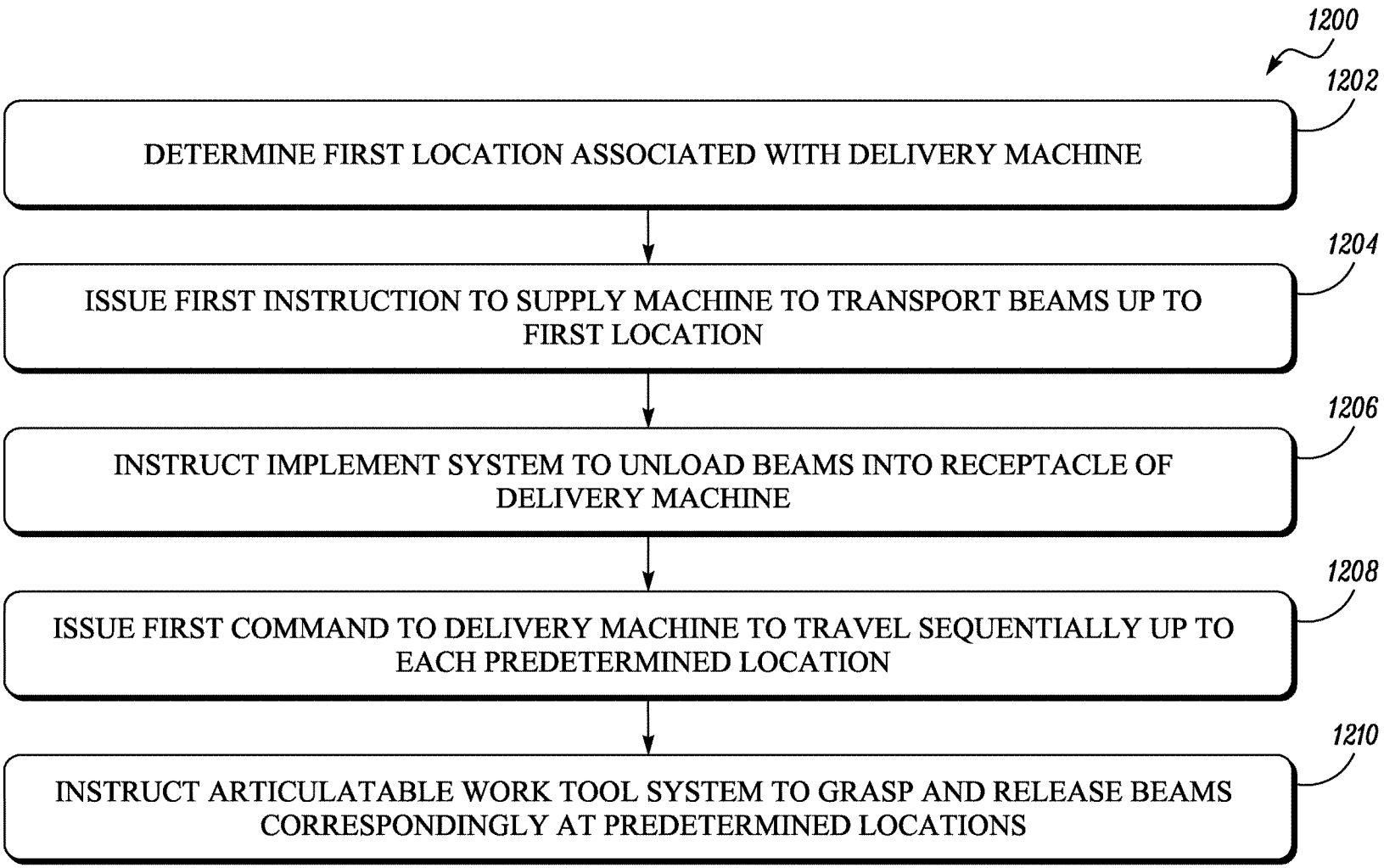
FIG. 12 is a flowchart illustrating a method for delivering the beams to the predetermined locations of the worksite, in accordance with one or more aspects of the present disclosure.

As discussed above, for the construction of any solar farm 302, the beams 306 are required to be delivered from the staging area 304 to the predetermined locations 312 of the construction area 310 of the worksite 300. FIG. 12 describes an exemplary method 1200 for delivering the beams 306 to the predetermined locations 312 of the worksite 300, at least in part, by using the supply machine 100 and the delivery machine 200. The method 1200 is discussed by way of a flowchart and is discussed in conjunction with FIGS. 1 to 11, as well. It will be appreciated that the order of steps described in the method 1200 is exemplary in nature and that the steps can be performed in a different order than what is set out below, as will be contemplated by a person skilled in the art based on the description of the present disclosure.

To construct the solar farm 302, a plurality of supply machines 100 and a plurality of delivery machines 200 may be employed at the worksite 300. Each of the plurality of supply machines 100 and the plurality of delivery machines 200 may be parked at respective designated areas on the worksite 300 by the respective operators of the supply machines 100 and the delivery machines 200. Further, each supply machine 100 may be operated by its operator to load the beams 306 from the staging area 304 of the worksite 300 onto the supply machine implement system 136 before or after parking the supply machine 100 at the designated area on the worksite 300.

The method 1200 for delivering the beams 306 to the predetermined locations 312 of the worksite 300, at least in part, by using the supply machine 100 and the delivery machine 200 begins when the remote controller 402 of the control system 400 sends an activation signal to each of the supply machine controller 120 and the delivery machine controller 220. In some embodiments, the method 1200 may begin when the remote controller 402 receives inputs from the operators of the respective supply machine 100 and delivery machine 200, via the supply machine transceiver 122 and the delivery machine transceiver 222, respectively.

The method 1200 begins with the control system 400 determining a first location 502 associated with the delivery machine 200 at the worksite 300, at 1202. In accordance with various embodiments, the first location 502 may be a real-time location of the delivery machine 200, a fixed location of the delivery machine 200, or a predicted location of the delivery machine 200 determined based on the real-time location of the delivery machine 200. In order to determine the first location 502 of the delivery machine 200, the remote controller 402 may obtain the location data corresponding to the real-time location of the delivery machine 200 from the delivery machine controller 220. To this end, the delivery machine controller 220 may obtain the location data of the delivery machine 200 from the one or more delivery machine location sensors 252 and provide the location data to the remote controller 402. In accordance with various embodiments, the fixed location may be a predefined location of the delivery machine 200 and data associated with the fixed location of the delivery machine 200 may be stored in the memory of the delivery machine 200. The remote controller 402 may obtain data associated with the fixed location of the delivery machine 200 from the delivery machine 200 via the delivery machine transceiver 222.

In accordance with various embodiments, the predicted location of the delivery machine 200 may be any location on the worksite 300 at which the delivery machine 200 is expected to arrive at (and exemplarily be stationed at) pursuant to its delivery of the beams 306 at the one or more predetermined locations 312 within a predefined time interval. The predicted location of the delivery machine 200 may depend on various factors, such as, the real-time location, the direction of travel, the speed of travel, the predefined travel path, and the like, of the delivery machine 200. In order to determine the predicted location of the delivery machine 200, in addition to the location data, the remote controller 402 may obtain the orientation data, and the speed data of the delivery machine 200. To this end, the delivery machine controller 220 may obtain the orientation data and the speed data of the delivery machine 200 from the one or more delivery machine speed sensors 254 and the delivery machine acceleration sensors 256 and provide the orientation data and the speed data to the remote controller 402. In some embodiments, data associated with the predefined travel path may also be provided to the remote controller 402 by the delivery machine controller 220 via the delivery machine transceiver 222. In alternate embodiments, the data associated with the predefined travel path of the delivery machine 200 may be stored in a memory (not shown) accessible by the remote controller 402.

The remote controller 402 may analyze the location data, orientation data, and the speed data along with the predefined travel path of the delivery machine 200 to extrapolate and arrive at the predicted location of the delivery machine 200 to obtain the predicted location of the delivery machine 200. In some alternate embodiments, the delivery machine controller 220 may obtain the predicted location of the delivery machine 200 and transmit it to the remote controller 402.

At 1204, the control system 400 issues a first instruction to the supply machine 100 to transport the beams 306 to the first location 502. To this end, the remote controller 402 of the control system 400 may issue the first instruction to the supply machine controller 120 of the supply machine 100 to transport the beams 306 to the first location 502. Upon receiving the first instruction, the supply machine controller 120 controls and/or instructs the supply machine power source 128 associated with the supply machine 100 to power the supply machine traction devices 134 to enable the supply machine 100 to travel to the first location 502.

In accordance with various embodiments, the control system 400 also generates a path from a current location of the supply machine 100 to the first location 502 at the worksite 300 for the supply machine 100 to follow. In order to determine the current location of the supply machine 100, the remote controller 402 may obtain the location data corresponding to the current location of the supply machine 100 from the supply machine controller 120. To this end, the supply machine controller 120 may obtain the location data of the supply machine 100 from the one or more supply machine location sensors 150 and provide the location data to the remote controller 402.

The remote controller 402 of the control system 400 may trace the current location of the supply machine 100 and the first location 502 of the delivery machine 200 on a map 500 (shown in FIG. 11) associated with the worksite 300. In accordance with various embodiments, the map 500 corresponds to a virtual representation of a layout of the worksite 300 and includes information associated with the generated paths, the construction area 310, the staging area 304, the predetermined locations 312, and the like, of the worksite 300. The remote controller 402 is configured to generate the path for the supply machine 100 from the current location of the supply machine 100 to the first location 502 of the delivery machine 200 at the worksite 300 and instructs the supply machine controller 120 to control the supply machine traction system 132 of the supply machine 100 to move along the generated path to reach the first location 502 of the delivery machine 200. For example, in an exemplary embodiment shown in FIGS. 5 and 6, the supply machine 100 can be seen moving towards the first location 502 of the delivery machine 200. In this exemplary embodiment, the supply machine controller 120 controls and/or instructs the supply machine power source 128 associated with the supply machine 100 to power the supply machine traction system 132 to move along the path 504 (shown in FIG. 11) to reach the first location 502 of the delivery machine 200.

At 1206, the control system 400 instructs the supply machine implement system 136 to unload the beams 306 into the receptacle 234 of the delivery machine 200 at the first location 502. For example, the remote controller 402 of the control system 400 may instruct the supply machine controller 120 to control the supply machine implement system 136 to unload the beams 306 into the receptacle 234 of the delivery machine 200 at the first location 502. To this end, the remote controller 402 may identify a position and an orientation of the receptacle 234 of the delivery machine 200 based on the location data and the orientation data obtained from the delivery machine location sensors 252 and the delivery machine acceleration sensors 256, via the delivery machine controller 220. The remote controller 402 may further determine a required alignment of the supply machine implement system 136 of the supply machine 100 with respect to the receptacle 234 such that the supply machine 100 and/or the supply machine implement system 136 of the supply machine 100 attains an unloadable orientation with respect to the receptacle 234 in which the items or beams 306 may be unloaded into the receptacle 234 from the supply machine 100. The remote controller 402 may provide instruction to the supply machine controller 120 to align the supply machine implement system 136 of the supply machine 100 with the receptacle 234 according to the determined alignment.

In an exemplary embodiment, in order to determine the required alignment, the remote controller 402 is configured to identify a position and an orientation of the supply machine implement system 136 of the supply machine 100 based on the location data and the orientation data obtained from the supply machine location sensors 150 and the supply machine acceleration sensor 154, via the supply machine controller 120. The remote controller 402 may further compare the position and orientation of the receptacle 234 with the position and orientation of the supply machine implement system 136 and provide coordinates to the supply machine controller 120 to align the position and orientation of the supply machine implement system 136 with the position and orientation of the receptacle 234 such that an unloading action is executed by the supply machine implement system 136 causing the beams 306, carried by the supply machine implement system 136, to be transferred into the receptacle 234 of the delivery machine 200.

Figure 7:
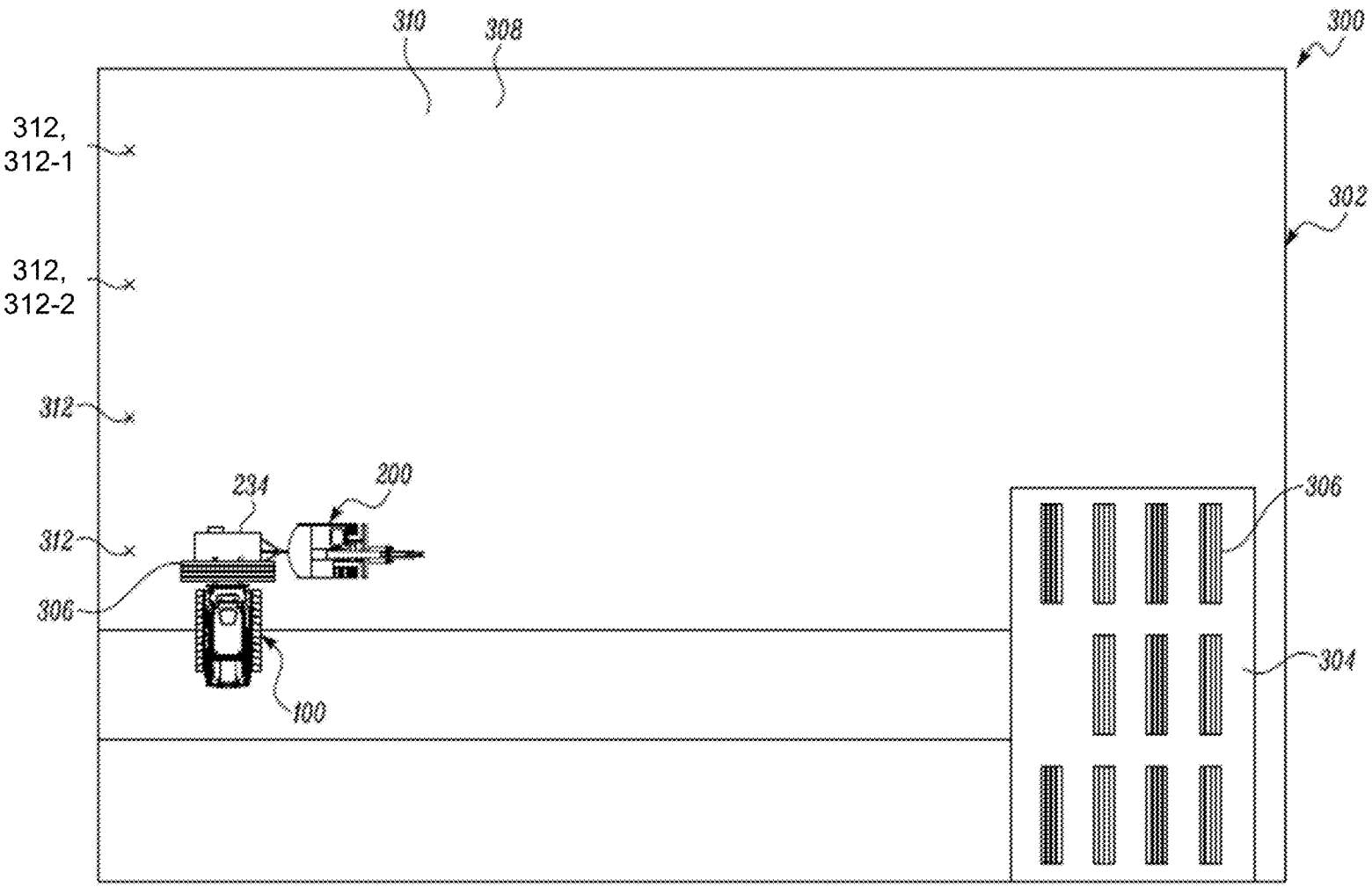

Once the position and orientation of the supply machine implement system 136 are aligned with the position and orientation of the receptacle 234, the remote controller 402 is configured to provide instructions to the supply machine controller 120 to control the supply machine implement system 136 to unload the one or more beams 306 on to the receptacle 234. In accordance with various embodiments, the delivery machine 200 may remain in a standby mode during the unloading process. The standby mode corresponds to a mode in which the delivery machine traction system 230 and the articulatable work tool system 236 of the delivery machine are not moving or are stationary but operational. For example, FIG. 7 illustrates the unloading of the beams 306 by the supply machine implement system 136 of the supply machine 100 on to the receptacle 234 of the delivery machine 200.

In some embodiments, the remote controller 402 may be configured to receive notification from the delivery machine 200 that the receptacle 234 has been successfully loaded. To this end, the delivery machine controller 220 is configured to obtain data associated with a number of beams 306 in the receptacle 234 from the receptacle sensors 260 and compare the number with a predetermined beams number. When the number of beams 306 in the receptacle 234 is equal to or greater than the predetermined beams number, the delivery machine controller 220 may be configured to provide the notification to the remote controller 402 indicating successful loading of the receptacle 234.

In some embodiments, the number of the beams 306 may be determined based on a total or overall weight of the items or the beams 306 which may be held by any of the supply machine 100 and/or the delivery machine 200 at any given point, and thus may be indicated by way of pressure sensors or weight sensors which may be suitably positioned on each of the supply machine 100 and the delivery machine 200. A greater pressure or weight may proportionally mean a larger number of beams 306, and, conversely, a reduced pressure or weight may proportionally mean a lesser number of beams 306. Effectively, a count of the beams 306 may be determined based on the weight of the beams 306. In this regard, the remote controller 402 (or any relevant controller) may be calibrated and/or pre-fed with a chart, a table, or the like, that enables the relevant controller performing the analysis to determine the number of beams 306 corresponding to the weight of the beams 306.

In accordance with various embodiments, the control system 400 may be configured to issue a second instruction to the supply machine 100 to return to a predetermined area, for example, the staging area 304 of the worksite 300 upon unloading the beams 306 into the receptacle 234 at the first location 502. For example, the remote controller 402 is configured to issue the second instruction to the supply machine controller 120 to control the supply machine traction system 132 to return to the predetermined area, for example, the staging area 304, of the worksite 300. To this end, the remote controller 402 may generate a return path for the supply machine 100 from the first location 502 to a location of the predetermined area of the worksite 300 and may provide data associated with the return path to the supply machine controller 120 to control the supply machine traction system 132. For example, in the exemplary embodiment shown in FIG. 8, the supply machine 100 can be seen moving from the first location 502 towards the predetermined area, for example, the staging area 304 of the worksite 300.

At 1208, the control system 400 issues a first command to the delivery machine 200 to travel sequentially to each predetermined location 312 of the one or more predetermined locations 312. For example, the remote controller 402 of the control system 400 may issue the first command to the delivery machine controller 220 to control the delivery machine traction devices 232 to travel sequentially to each predetermined location 312 of the one or more predetermined locations 312. To this end, the remote controller 402 of the control system 400 may provide or retrieve a map, for example, the map 500 (shown in FIG. 11) (from a memory) indicating the plurality of predetermined locations 312 along with routes 506 to be followed by the delivery machine 200 to travel sequentially to each predetermined location 312. Upon receiving the map 500, the delivery machine controller 220 controls and/or instructs the delivery machine power source 228 associated with the delivery machine 200 to power the delivery machine traction devices 232 to travel sequentially to each predetermined location 312 based on routes 506 indicated in the map 500. For example, in the exemplary embodiment shown in FIG. 8, the delivery machine 200 has travelled from the first location 502 to a first predetermined location 312-1 of the plurality of predetermined locations 312.

In accordance with various embodiments, the delivery machine 200 travels sequentially to each predetermined location 312 of the worksite 300 while avoiding obstacles on the routes 506. In order to do so, the delivery machine controller 220 may obtain data from the obstacle sensors 258 indicating presence of the object in a predefined area around the delivery machine 200. Upon detecting the presence of an object, the delivery machine controller 220 controls the delivery machine traction devices 232 to reduce the speed of or altogether stop the delivery machine 200. Further, when the object is determined to be a person, the delivery machine controller 220 instructs the delivery machine traction devices 232 to stop for a first predefined time period for the person to move out of the predefined area. When the person does not move out of the predefined area during the first predefined time period, the delivery machine controller 220 may determine an alternate path or requests the remote controller 402 to determine an alternate path for the delivery machine 200. When the object is determined to be an inanimate object, the delivery machine controller 220 controls the delivery machine traction devices 232 to drive around the inanimate object. If the delivery machine controller 220 determines that it is not possible to drive around the inanimate object, the delivery machine controller 220 determines an alternate path or requests the remote controller 402 to determine an alternate path for the delivery machine 200.

At 1210, the control system 400 instructs the articulatable work tool system 236 to grasp the beams 306 received within the receptacle 234, articulate itself suitably, and release the beams 306 correspondingly at the predetermined locations 312 to deploy the beams 306 at the predetermined locations 312 in preset orientations. For example, the remote controller 402 of the control system 400 instructs the delivery machine controller 220 to control the first arm 238, the second arm 240, and the clasping member 248 of the articulatable work tool system 236 to grasp the beams 306 received within the receptacle 234 and release the beams 306 correspondingly at the predetermined locations 312. Instructing the articulatable work tool system 236 may mean instructing various actuators associated with the articulatable work tool system 236 to perform corresponding actuations so as to suitably move the articulatable work tool system 236 to perform the above described grasping, articulation, and releasing operations.

In an exemplary embodiment, the delivery machine controller 220 may be configured to rotate the articulatable work tool system 236 such that the clasping member 248 of the articulatable work tool system 236 faces towards the receptacle 234 of the delivery machine 200. The first arm 238 and the second arm 240 of the articulatable work tool system 236 are then controlled by the delivery machine controller 220 such that the clasping member 248 of the articulatable work tool system 236 is suspended above the receptacle 234 of the delivery machine 200. The first arm 238 and the second arm 240 of the articulatable work tool system 236 are then controlled by the delivery machine controller 220 to enable the clasping member 248 to grasp a beam 306 of the one or more beams 306 from the receptacle 234. In accordance with various embodiment, to deploy the beams 306 in the preset orientation, the clasping member 248 of the articulatable work tool system 236 is configured to operatively engage with each beam 306 according to a predefined articulation pattern. Once the clasping member 248 grasps the beam 306, the articulatable work tool system 236 (not shown) is again rotated such that the clasping member 248 faces towards a predetermined location 312, for example, a first predetermined location 312-1, of the worksite 300. The delivery machine controller 220 is then configured to release the first beam 306' on the first predetermined location 312-1 in the preset orientation.

Figure 8:
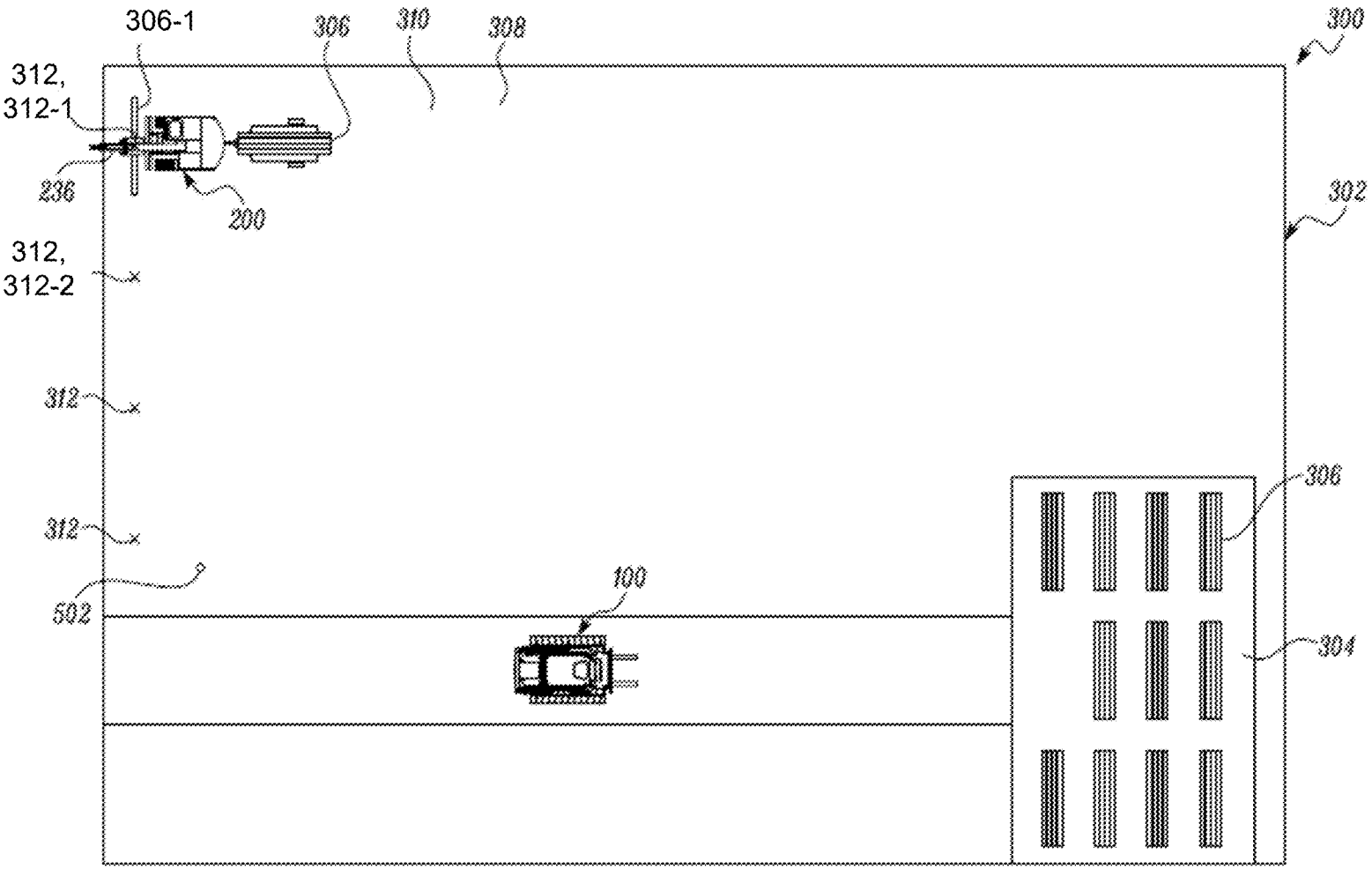

For example, in the exemplary embodiment shown in FIG. 8, the delivery machine 200 releases a first beam 306-1 on a first predetermined location 312-1 of the worksite 300 using the articulatable work tool system 236. In accordance with various embodiments, once the first beam 306-1 is released at the first predetermined location 312-1, the remote controller 402 instructs the delivery machine 200, via the delivery machine controller 220, to travel to a second predetermined location 312-2 of the predetermined locations 312 and repeat the same steps for releasing a second beam at the second predetermined location 312-2. The delivery machine controller 220 is configured to travel sequentially to the next or subsequent predetermined locations 312 until all beams 306 in the receptacle 234 are released, e.g., one at each predetermined location 312. Once all the beams 306 in the receptacle 234 are delivered at the predetermined locations 312, the delivery machine 200 may switch to the standby mode until the receptacle 234 is replenished with another set of beams 306. In some embodiments, the delivery machine 200 may travel to the fixed location or the predicted location before activation of the standby mode.

While the delivery machine 200 is grasping and releasing the one or more beams 306 at the predetermined locations 312 on the worksite 300, the delivery machine controller 220 is also configured to detect using the receptacle sensors 260, a number of the beams 306 left in the receptacle 234 and transmits the number to the remote controller 402. The remote controller 402 then issues a third instruction to the supply machine 100 (i.e., the supply machine controller 120 of the supply machine 100) to replenish the receptacle 234 of the delivery machine 200 with additional one or more beams when the number of beams in the receptacle of the delivery machine 200 is less than a predefined threshold number. In some embodiments, the remote controller 402, upon receiving an indication that the delivery machine 200 is in the standby mode may issue the third instruction to the supply machine 100 to replenish the receptacle 234 of the delivery machine 200. In some embodiments, the remote controller 402 may predict that there is a need to replenish the receptacle 234 of the delivery machine 200 based on a time taken by the delivery machine 200 to travel to each predetermined location 312, a time taken to grasp and release a beam 306, and a number of beams 306 in the receptacle 234 of the delivery machine 200.

Figure 9:
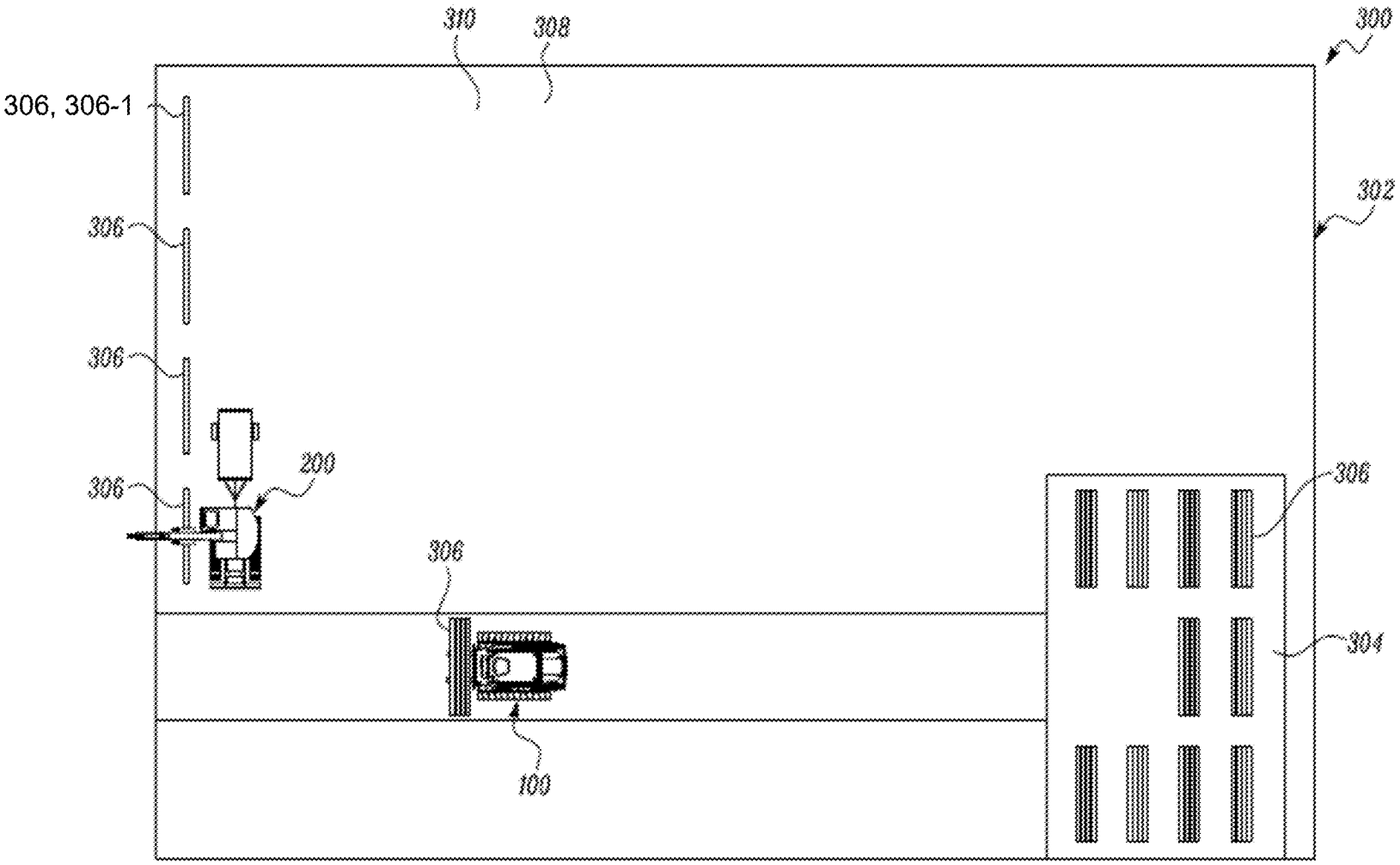
Figure 10:
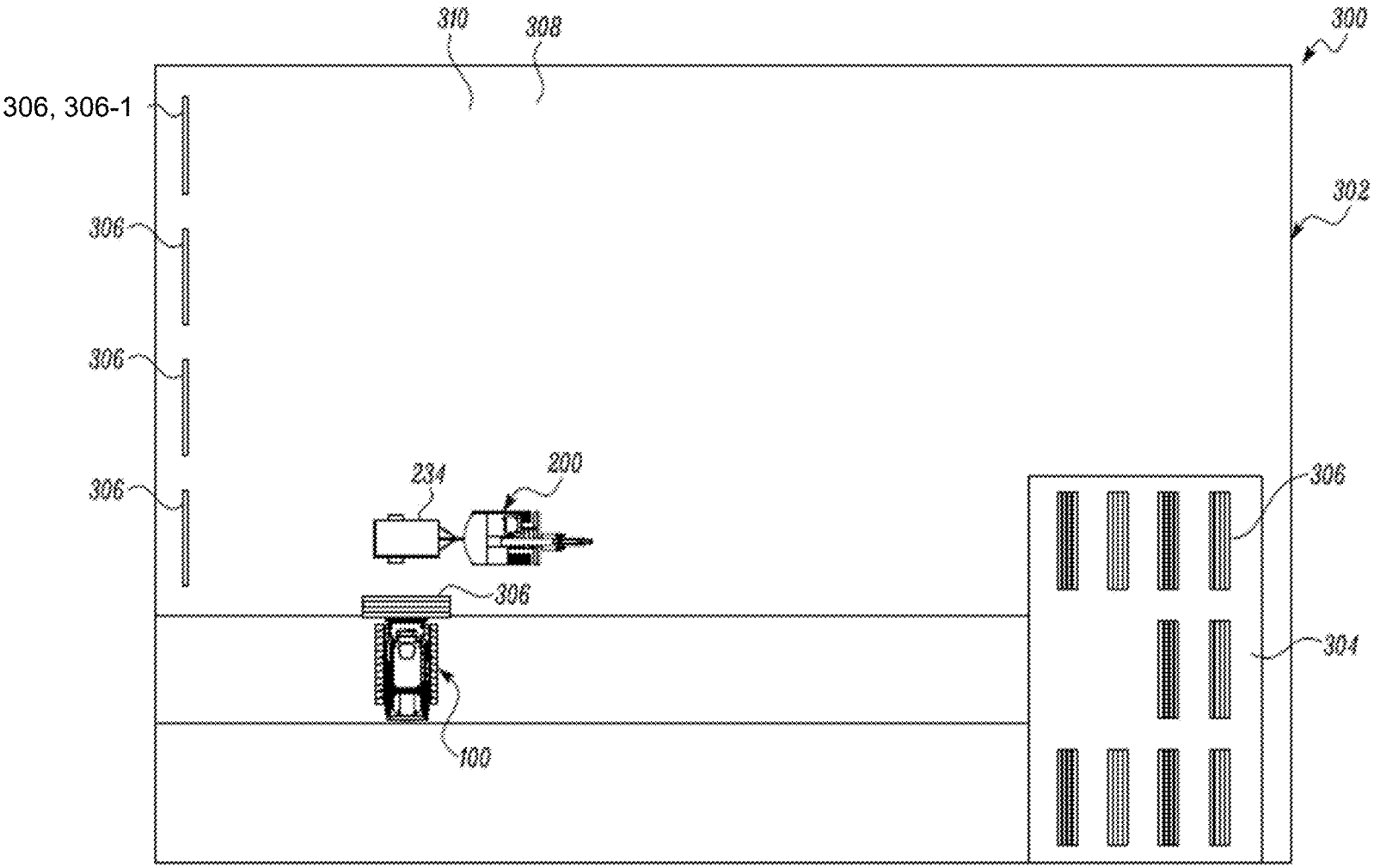
Figure 11:
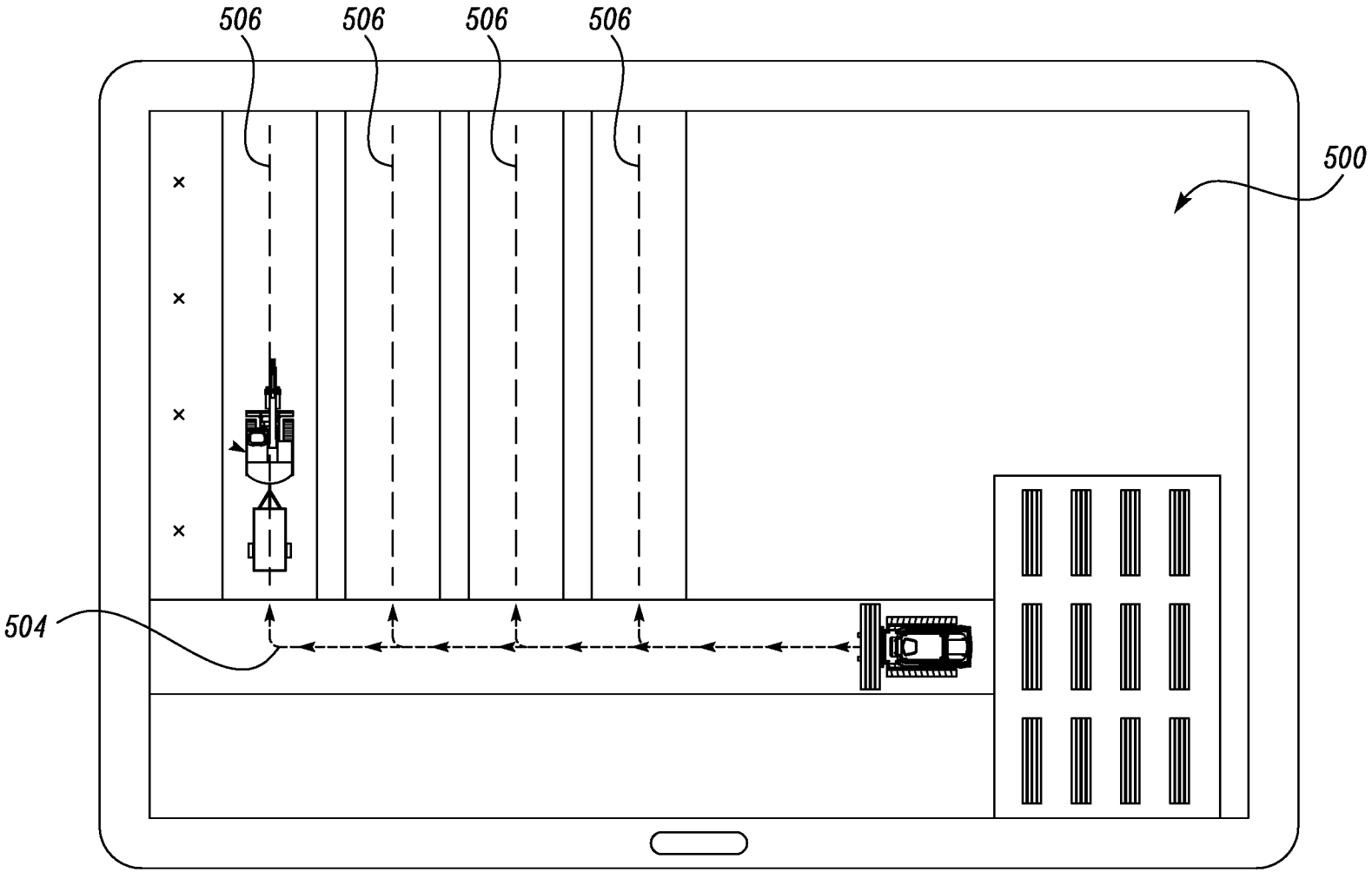

To this end, the remote controller 402 is configured to repeat the steps of the flowchart 1200 of FIG. 1. For example, as shown in FIGS. 9 and 10, the supply machine 100 loaded with the additional one or more beams 306 on the supply machine implement system 136 is travelling towards the delivery machine 200 to load the additional one or more beams 306 on the receptacle 234 of the delivery machine 200. In accordance with various embodiments, a speed of travel of the supply machine 100 is greater than a speed of travel of the delivery machine 200. This ensures that the beams 306 are delivered quickly to the delivery machine 200 at the worksite 300.

In alternate embodiments, the remote controller 402 of the control system 400 transmits an availability inquiry message to the plurality of supply machines 100 (i.e., respective supply machine controllers 120 of the supply machines 100) available at the worksite 300 to determine availability of at least one supply machine 100 of the plurality of supply machines 100 to replenish the receptacle 234 of the delivery machine 200. Upon transmitting the availability inquiry message, the remote controller 402 of the control system 400 waits for the at least one supply machine 100 of the plurality of supply machines 100 to respond to the availability inquiry message. The remote controller 402 identifies a supply machine 100 (i.e., the respective supply machine controller 120 of the supply machine 100) that responds first to the availability inquiry message with an availability response and issues a third instruction to an available supply machine 100 (i.e., the respective supply machine controller 120 of the available supply machine 100) to replenish the receptacle 234 of the delivery machine 200. In accordance with various embodiments, the remote controller 402 of the control system 400 further cancels the transmission of the third instruction to remaining supply machines 100 of the plurality of supply machine 100 upon receiving the availability response from the available supply machine 100.

The present disclosure provides the method 1200 and the control system 400 for delivering beams 306 to one or more predetermined locations 312 of the worksite 300 using the supply machine 100 and the delivery machine 200. The supply machine 100 and the delivery machine 200 are controlled in an autonomous manner to perform delivery of beams 306 without any need for the labors to manually pick and deliver the beams 306 to the predetermined locations 312. Moreover, the beams 306, delivered in loose batches at the staging area 304, are autonomously unloaded to be placed at the predetermined locations 312, which contrasts to conventional methods involving manual staffing, commensurate expenditure, onsite personal management, and which are by themselves time-consuming and labor-intensive activities.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A method for delivering one or more beams to one or more predetermined locations of a worksite, the method comprising:

determining, by a control system, a first location associated with a delivery machine at the worksite;

issuing, by the control system, a first instruction to a supply machine to transport the one or more beams to the first location;

instructing, by the control system, an implement system of the supply machine to unload the one or more beams into a receptacle at the first location;

issuing, by the control system, a first command to the delivery machine to travel sequentially to each predetermined location of the one or more predetermined locations; and instructing, by the control system, an articulatable work tool system of the delivery machine to grasp the one or more beams within the receptacle and place the one or more beams correspondingly at the one or more predetermined locations for deployment in one or more preset orientations completely above a ground surface.

2. The method as claimed in claim 1, wherein the first location is a real-time location of the delivery machine or a predicted location of the delivery machine determined based on the real-time location.

3. The method as claimed in claim 1, further comprising:

issuing, by the control system, a second instruction to the supply machine to return to a predetermined area of the worksite upon unloading the one or more beams into the receptacle at the first location.

4. The method as claimed in claim 1, wherein instructing the articulatable work tool system to grasp the one or more beams within the receptacle comprises:

instructing, by the control system, the articulatable work tool system to operatively engage with each beam, of the one or more beams, according to a predefined articulation pattern.

5. The method as claimed in claim 1, further comprising:

detecting, by one or more sensors, a number of the one or more beams in the receptacle; and issuing, by the control system, a third instruction to the supply machine to replenish the receptacle with one or more additional beams when the number of beams in the receptacle is less than a predefined threshold number.

6. The method as claimed in claim 1, further comprising:

transmitting, by the control system, an availability inquiry message to a plurality of supply machines available at the worksite to determine availability of at least one supply machine of the plurality of supply machines to replenish the receptacle; and issuing, by the control system, a third instruction to an available supply machine, of the plurality of supply machine, to replenish the receptacle.

7. The method as claimed in claim 6, further comprising:

canceling, by the control system, transmission of the third instruction to remaining supply machines of the plurality of supply machines upon receiving an availability response from the available supply machine.

8. The method as claimed in claim 1, wherein issuing the first instruction to the supply machine to transport the one or more beams to the first location comprises:

tracing, by the control system, a current location of the supply machine and the first location on a map associated with the worksite;

generating, by the control system, a path from the current location to the first location; and instructing, by the control system, a traction system of the supply machine to move along the path.

9. The method as claimed in claim 1, wherein instructing the implement system of the supply machine to unload the one or more beams into the receptacle of the delivery machine at the first location comprises:

identifying, by the control system, a position and an orientation of the receptacle;

aligning, by the control system, at least one of the supply machine or the implement system with the receptacle such that the at least one of the supply machine or the implement system attains an unloadable orientation with respect to the receptacle; and moving, by the control system, the implement system such that an unloading action is executed by the implement system to cause the one or more beams, carried by the implement system, to be transferred into the receptacle.

10. The method as claimed in claim 1, wherein issuing the first instruction to the supply machine to transport the one or more beams to the first location comprises:

issuing the first instruction to the supply machine to transport the one or more beams to the first location at a first travel speed, wherein issuing the first command to the delivery machine to travel sequentially to each predetermined location of the one or more predetermined locations comprises:

issuing the first command to the delivery machine to travel sequentially to each predetermined location of the one or more predetermined locations at a second travel speed of the delivery machine, wherein the second travel speed is less than the first travel speed.

11. A system for delivering one or more beams to one or more predetermined locations of a worksite, the system comprising:

a delivery machine including a receptacle to receive the one or more beams and an articulatable work tool system to operatively engage with each beam of the one or more beams when received in the receptacle;

a supply machine including an implement system to carry the one or more beams to a first location associated with the delivery machine at the worksite and supply the one or more beams to the delivery machine at the first location; and a control system coupled to the delivery machine and the supply machine, the control system is configured to:

determine the first location associated with the delivery machine at the worksite;

issue a first instruction to the supply machine to transport the one or more beams to the first location;

instruct the implement system to unload the one or more beams into the receptacle at the first location;

issue a first command to the delivery machine to travel sequentially to each predetermined location of the one or more predetermined locations while retaining at least one of the one or more beams within the receptacle during travel; and instruct the articulatable work tool system to grasp the one or more beams received within the receptacle and place the one or more beams correspondingly at the one or more predetermined locations for deployment in one or more preset orientations completely above a ground surface.

12. The system as claimed in claim 11, wherein the first location is a real- time location of the delivery machine or a predicted location of the delivery machine determined based on the real-time location.

13. The system as claimed in claim 11, wherein the control system is further configured to:

issue a second instruction to the supply machine to return to a predetermined area of the worksite upon unloading the one or more beams into the receptacle at the first location.

14. The system as claimed in claim 11, wherein to instruct the articulatable work tool system to grasp the one or more beams within the receptacle, the control system is configured to:

instruct the articulatable work tool system to operatively engage with each beam, of the one or more beams, according to a predefined articulation pattern.

15. The system as claimed in claim 11, further comprising:

one or more sensors configured to detect a number of the one or more beams in the receptacle; and wherein the control system is further configured to:

issue a third instruction to the supply machine to replenish the receptacle with additional one or more beams when the number of beams in the receptacle is less than a predefined threshold number.

16. The system as claimed in claim 11, wherein the control system is further configured to:

transmit an availability inquiry message to a plurality of supply machines available at the worksite to determine availability of at least one supply machine of the plurality of supply machines to replenish the receptacle; and issue, by the control system, a third instruction to an available supply machine to replenish the receptacle.

17. The system as claimed in claim 16, wherein the control system is further configured to:

cancel transmission of the third instruction to remaining supply machines of the plurality of supply machines upon receiving an availability response from the available supply machine.

18. The system as claimed in claim 11, wherein to issue the first instruction to the supply machine to transport the one or more beams to the first location, the control system is further configured to:

trace a current location of the supply machine and the first location on a map associated with the worksite;

generate a path from the current location to the first location; and instruct a traction system of the supply machine to move along the path.

19. The system as claimed in claim 11, wherein to instruct the implement system of the supply machine to unload the one or more beams into the receptacle at the first location, the control system is configured to:

identify a position and an orientation of the receptacle;

align at least one of the supply machine or the implement system with the receptacle such that the at least one of the supply machine or the implement system attains an unloadable orientation with respect to the receptacle; and move the implement system such that an unloading action is executed by the implement system to cause the one or more beams, carried by the implement system, to be transferred into the receptacle.

20. The system as claimed in claim 11, wherein to issue the first instruction to the supply machine to transport the one or more beams to the first location, the control system is configured to:

issue the first instruction to the supply machine to transport the one or more beams to the first location at a first travel speed, wherein to issue the first command to the delivery machine to travel sequentially to each predetermined location of the one or more predetermined locations, the control system is configured to:

issue the first command to the delivery machine to travel sequentially to each predetermined location of the one or more predetermined locations at a second travel speed, wherein the second travel speed is less than the first travel speed.

* * * * *